US005445544A

United States Patent [19]

Weiland et al.

[11] Patent Number: 5,445,544

[45] Date of Patent: Aug. 29, 1995

[54] WIRE END FERRULE

[75] Inventors: Bruno Weiland, Wangen; Herbert Leonhardt, deceased, late of Kissleg, by Charlotte A. Leonhardt, heiress; Claus Geier, Kissleg; Hans Froehlich, Wangen, all of Germany

[73] Assignees: GLW- Elektrotechnische Bauteile-Kunststoffverarbeitung GmbH, Kissleg; Zoller & Froehlich GmbH, Wangen, both of Germany

[21] Appl. No.: 146,020

[22] PCT Filed: Apr. 24, 1992

[86] PCT No.: PCT/DE92/00331

§ 371 Date: Jun. 10, 1994

§ 102(e) Date: Jun. 10, 1994

[87] PCT Pub. No.: WO92/20118

PCT Pub. Date: Nov. 12, 1992

[30] Foreign Application Priority Data

May 8, 1991 [DE] Germany ..... 41 15 020.1

[51] Int. Cl.[6] ..... H01R 4/10

[52] U.S. Cl. ..... 439/879

[58] Field of Search ..... 439/879, 880, 882; 174/80, 87

[56] References Cited

U.S. PATENT DOCUMENTS 2,526,277 10/1950 Rogoff .
2,729,695 1/1956 Pierce .
2,774,810 12/1956 Ritter .
2,982,808 5/1961 Schwfster ..... 439/880 X
3,184,817 5/1965 Archer et al. .
3,868,475 2/1975 Allison .
4,404,744 9/1983 Stenz et al. .
4,969,845 11/1990 Hauchard et al. .

FOREIGN PATENT DOCUMENTS

78328/75 5/1979 Austria .
1468859 10/1989 France .
1084337 6/1960 Germany .
1145246 3/1963 Germany .
1590140 5/1970 Germany .
2058574 5/1972 Germany .
7240846 2/1973 Germany .
2614577 8/1977 Germany .
3314295 5/1984 Germany .
3610086 10/1986 Germany .
3611154 10/1987 Germany .
9105498 U 10/1991 Germany .

OTHER PUBLICATIONS

DIN 46 228 Part 4. Sep. 1990, pp. 1–4.

*Primary Examiner*—Eugene F. Desmond
*Attorney, Agent, or Firm*—Spencer, Frank & Schneider

[57] ABSTRACT

A wire end-sleeve consisting of a front cylindrical metal sleeve (2) and a rear injection-moulded plastic collar (4). In order to be able to insert two conductors (10,11) into a wire end-sleeve (1), the inside cross-section of the plastic collar (4) is oval and designed to be capable of taking two conductors (10,11) side by side.

2 Claims, 2 Drawing Sheets

WIRE END FERRULE

DESCRIPTION

The invention relates to a wire end ferrule according to the preamble of claim 1.

PRIOR ART

Wire end ferrules of the generic type are disclosed in DE 2,941,770 C2 or DE 3,314,295 C1. Such wire end ferrules are used to produce solderless electrical connections, a crimping tool being used to press or crimp the stripped end of a conductor to the wire end ferrule. Such a crimping tool is shown, for example, in DE 2,614,577 B1.

Wire and ferrules consist of a front cylindrical metal tube or a metal sleeve having, integrally extruded or plugged thereon, a rear plastic collar as insulating sleeve. The stripped part of the finely stranded conductor is inserted into the wire end ferrule from behind into the plastic collar, and crimped in the region of the metal sleeve, resulting in the permanent connection. The rear integrally extruded plastic collar accommodates the conductor with the insulation as insulating sleeve.

The different diameters or dimensions of wire end ferrules are laid down in DIN 46 228 Part 4. In this case, the cylindrical plastic collar and the front cylindrical metal tube are dimensioned such that in each case only one conductor can be properly inserted and crimped.

When conductors are mounted on switchboxes, as indicated, for example, in FR 1,468,859, FIG. 1, it frequently happens that a plurality of conductors have to be simultaneously screwed onto a switch terminal. For this purpose, it is known for two conductors to be inserted into a wire end ferrule which fits in some shape or other, in order to be mounted jointly on a supply terminal. In this case, the cross-section of the metal tube is selected such that this corresponds approximately to twice the conductor cross-section of the litz wires, so that the latter can be inserted. If such a cylindrical cross-section of the metal tube is selected, the associated cylindrical plastic collar of this wire end ferrule is dimensioned in such a way that it cannot accommodate two juxtaposed conductors. It therefore has to be brought by means of mechanical deformation into an oval shape whose dimensional variations are not, however, adapted to juxtaposed conductors. Moreover, it is possible only with difficulty for such a deformation process of the plastic collar to be automated.

If a plastic collar is selected which has an inside diameter corresponding to two juxtaposed conductors, the cross-section of the associated metal tube generally has excessive dimensions.

In known wire end ferrules, it is therefore disadvantageous that in the case of small switching devices or terminals it is impossible, or possible only with difficulty, to underclamp two conventional wire end ferrules in order to continue the electrical connection.

ADVANTAGES OF THE INVENTION

The wire end ferrule according to the invention having the characterizing features of claim 1 has, by contrast, the advantage that said ferrule is configured in such a way that it can accommodate two conductors without any problem, without having to undertake a mechanical deformation of the plastic collar. Here, the invention proceeds from the finding that adapting the cross-sectional ratios of the metal tube and the metal sleeve must be performed in such a way that the latter in each case comprises a circular cylindrical cross-section which can accommodate two conductor ends twisted one in another, while the oval cross-section of the adjoining plastic collar is dimensioned such that said collar can accommodate the two conductors in a juxtaposed fashion. A geometrical reshaping of the wire end ferrules is necessary to this extent, that is to say the circular cylindrical cross-section of the metal tube largely corresponds to twice the cross-section of the stripped conductor, while the plastic collar of oval cross-section has to accommodate two juxtaposed conductors with their insulating wrappers.

Further details of the invention are represented in the drawing and explained in more detail in the following exemplary embodiment.

DESCRIPTION OF THE INVENTION

Figure 1:
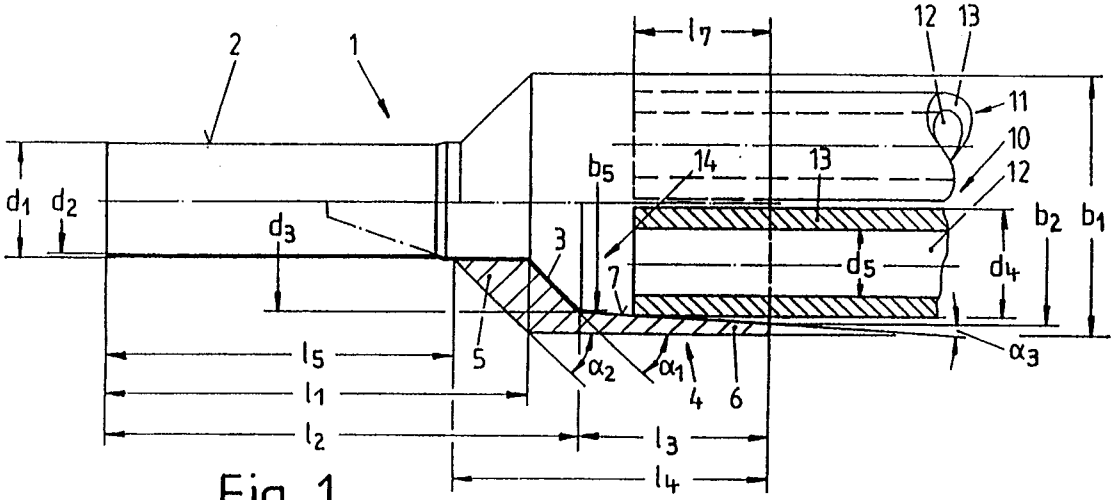
FIG. 1 shows a plan view of the wire end ferrule, half cut away.
Figure 3:
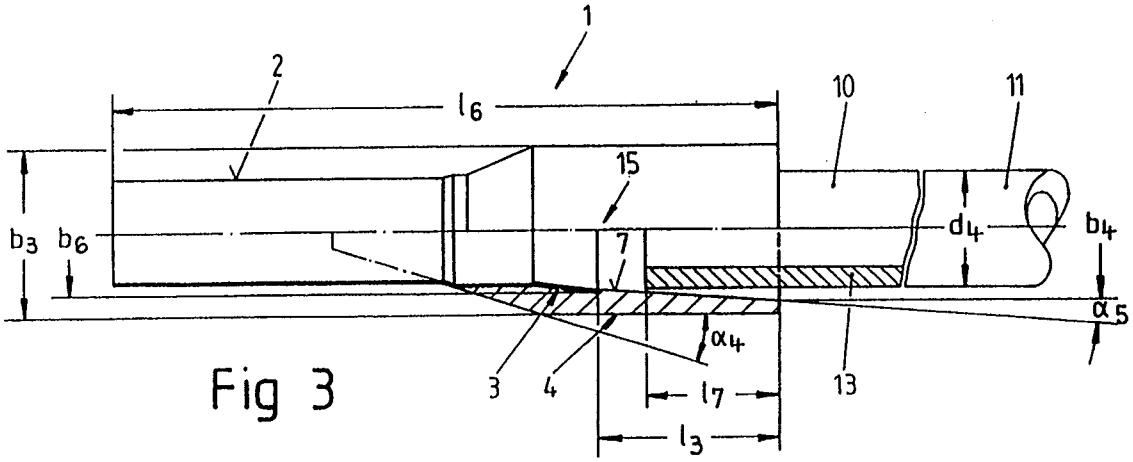
FIG. 3 shows a side view of the wire end ferrule according to FIG. 1.
Figure 2:
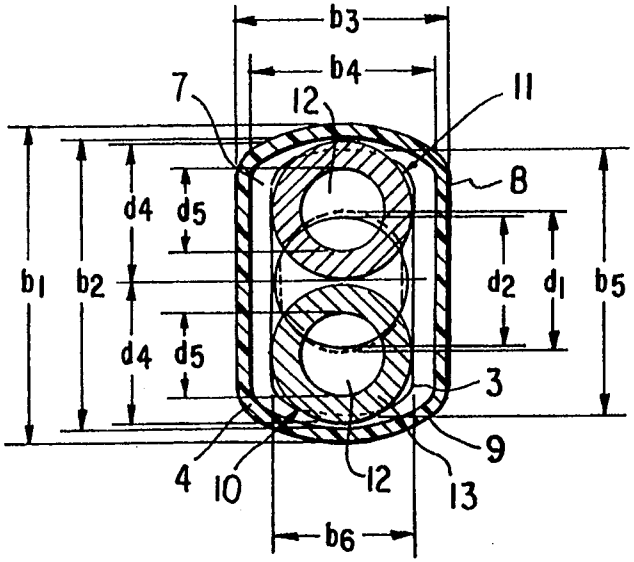
FIG. 2 shows a plan view of the cross-section of the plastic collar.

The wire end ferrule 1 represented in various views in FIGS. 1 to 3 consists of a front cylindrical metal tube or a metal sleeve 2 having a front outside diameter $d_1$ and an inside diameter $d_2$. The cylindrical part of the metal sleeve 2 extends over a length $\mathbf{1}_1$ and then opens out into a conical section 3 having a taper angle of $\alpha_1 \approx 40°$. The overall length of the metal sleeve 2 is specified by 12. The outside diameter of the conical section 3 is denoted by $d_3$.

The conical section 3 of the metal sleeve 2 is injection molded with a plastic collar 4 which has a front conical section 5 and a rear cylindrical section 6 of length $\mathbf{1}_3$. The overall length of the plastic collar 4 is specified by $\mathbf{1}_4$. The plastic collar 4 starts from a length of $\mathbf{1}_5$ on the metal sleeve 2. The overall length of the wire end ferrule is specified by $\mathbf{1}_6$.

The taper angle of the plastic collar 4 in FIG. 1 is $\alpha_2 \approx 45°$. The inner circumferential surface 7 of the cylindrical part 6 of the plastic collar 4 of length $\mathbf{1}_3$ likewise extends slightly conically with a taper angle of $\alpha_3 \approx 3°$. The above values hold for the plan view of the wire end ferrule in accordance with FIG. 1.

In the side view of the wire end ferrule in accordance with FIG. 3, the plastic collar 4 has a front taper angle of $\alpha_4 \approx 20°$ and a taper angle of $\alpha_5 \approx 5°$ for the inner circumferential surface. In this case, the conical section 3 of the metal sleeve 2 has the same taper angle of $\alpha_5$ as the inner circumferential surface 7 of the plastic collar 4.

As may be seen in conjunction with FIGS. 1 to 3, the plastic collar 4 is provided with an oval shape, as is particularly to be discerned in plan view from FIG. 2. The wider end of the plastic collar 4 has an outer width of $b_1$ and an inner width $b_2$. This end is labelled with the reference 8. The narrower end 9 of the plastic collar 4, which has the shape of a circular segment, has an outer width $b_3$ and an inner width $b_4$. The difference between these widths yields the wall thickness of the plastic collar 4. The conical shape of the inner circumferential surface 7 of the plastic collar 4 leads after the length $\mathbf{1}_3$ to an inner width $b_5$ as the wider and be as the narrower inside length.

As may be seen, furthermore, from FIGS. 1 to 3, the wire end ferrule 1 according to the invention serves to accommodate two conductors 10, 11 which in each case have an inner conductor litz wire 12 and, surrounding the latter, an insulating wrapper 13. The conductors 10, 11 have an outside diameter $d_4$ and the conductor litz wires 12 an outside diameter $d_5$.

The wire end ferrule 1 is dimensioned with respect to its metal sleeve 2 in such a way that the cross-sections of the conductor litz wires 12 of the two conductors 10, 11 can easily be inserted into the metal tube 2 after they have been stripped. The inside cross-section of the metal sleeve 2 must therefore amount to at least the sum of the two cross-sections of the conductors 10, 11.

In like manner, the inner width $b_2$ at the end of the plastic collar 4 or in the front region 14 of the circumferential surface 7 of the cone, that is to say after approximately the length $1_3$, must be dimensioned in such a way that the two conductors 10, 11 can be juxtaposed with their outside diameter $d_4$. The widths $b_2$ and $b_5$, respectively, must therefore amount to approximately twice $d_4$ (see FIGS. 1 and 2). The same holds for the inner width $b_6$ in the front region 15 of the circumferential surface 7 of the cone in FIG. 3, which likewise has to correspond approximately to the outside diameter $d_4$ of the conductors 10, 11. In the exemplary embodiment represented, the insulating wrapper 13 is not pushed as far as the foremost region 14, 15 of the conical inner circumferential surface ($1_3$), but is pushed in only up to a length $1_7$. An adequate push-in length of the insulating wrapper 13 is decisive.

By tuning the cross-sections of the plastic collar 4 as a function of the juxtaposed conductors 10, 11 which are to be inserted, and by tuning the cross-section of the associated metal sleeve 2 for adaptation to the cross-sections of the two conductor litz wires 12, which are to be inserted, of the two conductors 10, 11, the wire end ferrule is adapted to the geometrical conditions of the conductors to be manipulated.

The invention is not restricted to the exemplary embodiment described and represented. Rather, it also comprises all developments by the person skilled in the art within the scope of the concept according to the invention. Instead of an oval cross-section of the plastic collar, it is also possible to use a rectangular cross-section with a lateral boundary shaped like a circular segment or the like.

It is claimed:

1. Wire end ferrule for accommodating finely stranded conductors which form a crimp connection with the wire end ferrule, having a front cylindrical metal sleeve for accommodating a stripped conductor part and having, connected thereto, a rear plastic collar as insulating sleeve for accommodating the conductor with an insulating wrapper, characterized in that for the purpose of simultaneously accommodating two conductors (10, 11) in a wire end ferrule (1) the circular inner cross-section (diameter $d_2$) of the metal sleeve (2) is dimensioned in such a way that it accommodates the two stripped conductor litz wires (12) of the conductors (10, 11), and in that the plastic collar (4) adjoining the metal sleeve (2) has an approximately oval or rectangular inner cross-section (4), whose longer width $b_2$ is dimensioned in such a way that at least two juxtaposed conductors (10, 11) can be inserted together with their insulating wrapper (13).

2. Wire end ferrule according to claim 1, characterized in that the plastic collar (4) has a free, approximately oval inner cross-section whose longer width $b_2$ corresponds approximately to the width of two juxtaposed conductors (10, 11) including the insulating wrapper (13) and whose shorter width $b_4$ corresponds approximately to the diameter $d_4$ of the conductors (10, 11), and in that the circular cylindrical cross-section of the metal sleeve (2) has a free inner cross-section which corresponds approximately to the sum of the cross sections of the two conductor litz wires (12) of the conductors (10, 11).

* * * * *